United States Patent [19]

Ruff

[11] 3,931,925

[45] Jan. 13, 1976

[54] PAPERBOARD CONTAINER LID CONVERTIBLE INTO A SPOON

[76] Inventor: Stanley L. Ruff, 9 Arbor Drive, New Rochelle, N.Y. 10804

[22] Filed: Apr. 5, 1974

[21] Appl. No.: 458,317

[52] U.S. Cl. ..... 229/43; 229/1.5 C; 30/328

[51] Int. Cl.[2] ..... B65D 3/16

[58] Field of Search ..... 229/43, 1.5 C; 30/324, 30/328; 220/90.4

[56] References Cited

UNITED STATES PATENTS

| | | | |
|---|---|---|---|
| 1,521,768 | 1/1925 | Herrmann | 30/328 |
| 1,633,605 | 6/1927 | Prudden | 229/1.5 C |
| 1,851,942 | 3/1932 | Christie | 30/328 |
| 1,907,737 | 5/1933 | Christie | 30/328 |
| 2,375,266 | 5/1945 | Wilson | 229/1.5 C |
| 2,453,393 | 11/1948 | Wilson | 229/1.5 C |
| 2,598,987 | 6/1952 | Franzen | 229/1.5 C |
| 3,204,805 | 9/1965 | May | 220/90.4 UX |
| 3,458,107 | 7/1969 | Lane et al. | 229/1.5 C |
| 3,828,999 | 8/1974 | Humphrey | 229/1.5 C |

*Primary Examiner*—Davis T. Moorhead

*Attorney, Agent, or Firm*—Kirschstein, Kirschstein, Ottinger & Frank

[57] ABSTRACT

A flat paper lid for a container. The lid is formed with weakened zones such as crease-score lines which enable the lid, that at the time of purchase closes an open-mouthed container holding a ladleable mass of a comestible product, to be quickly and easily converted by manual manipulation into a spoon-like eating implement.

3 Claims, 14 Drawing Figures

FIG. 1
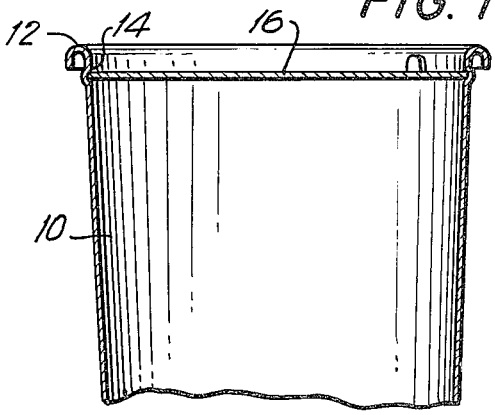
FIG. 2
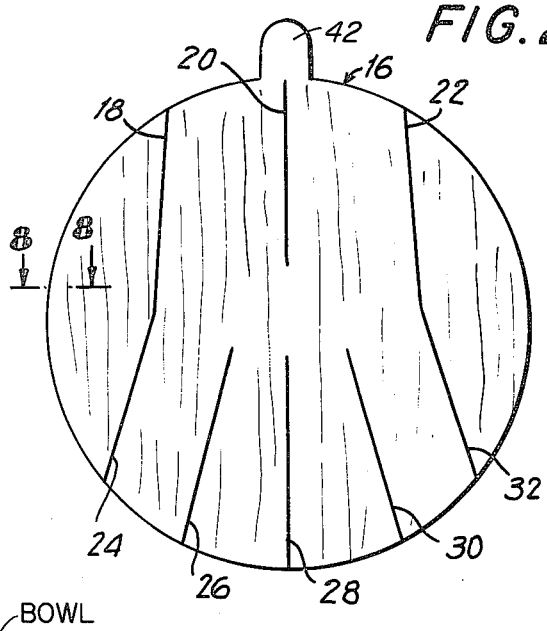
FIG. 3
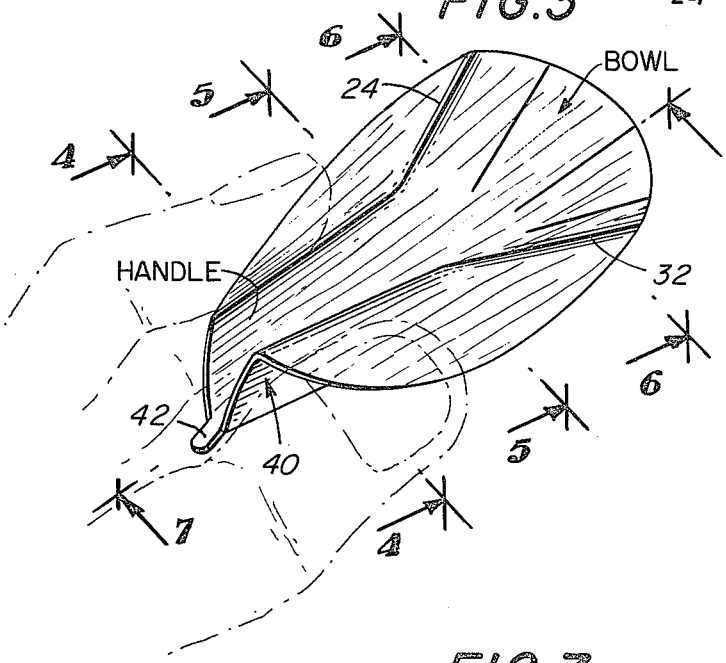
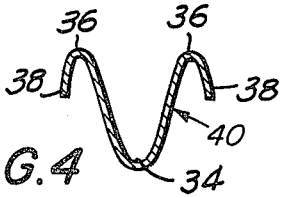
FIG. 4
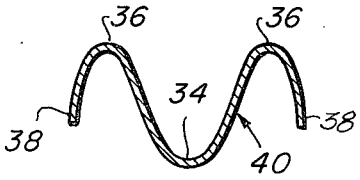
FIG. 5
FIG. 7
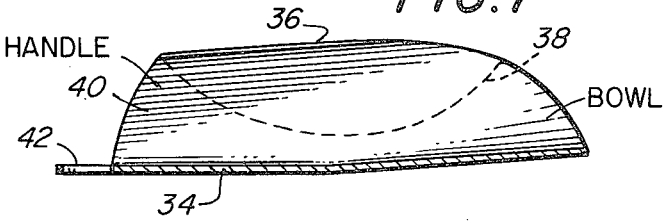
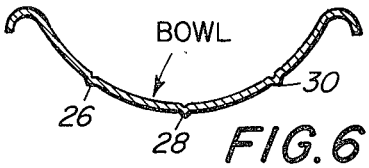
FIG. 6
FIG. 8
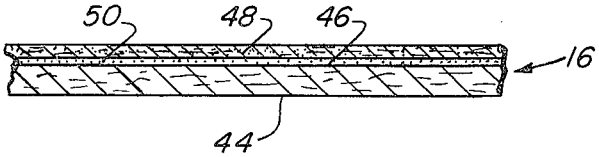

FIG. 9
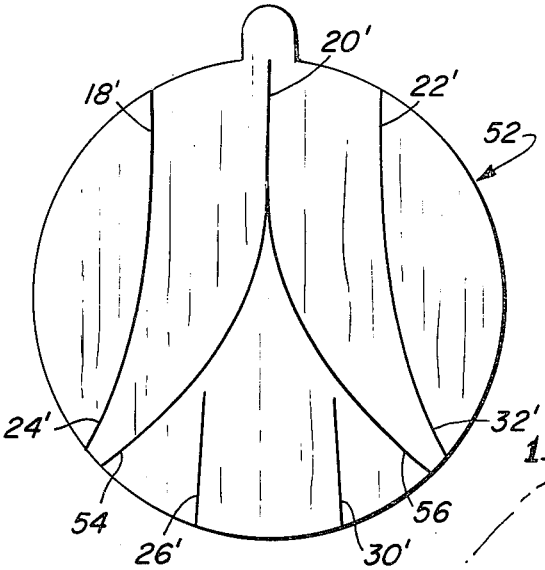
FIG. 10
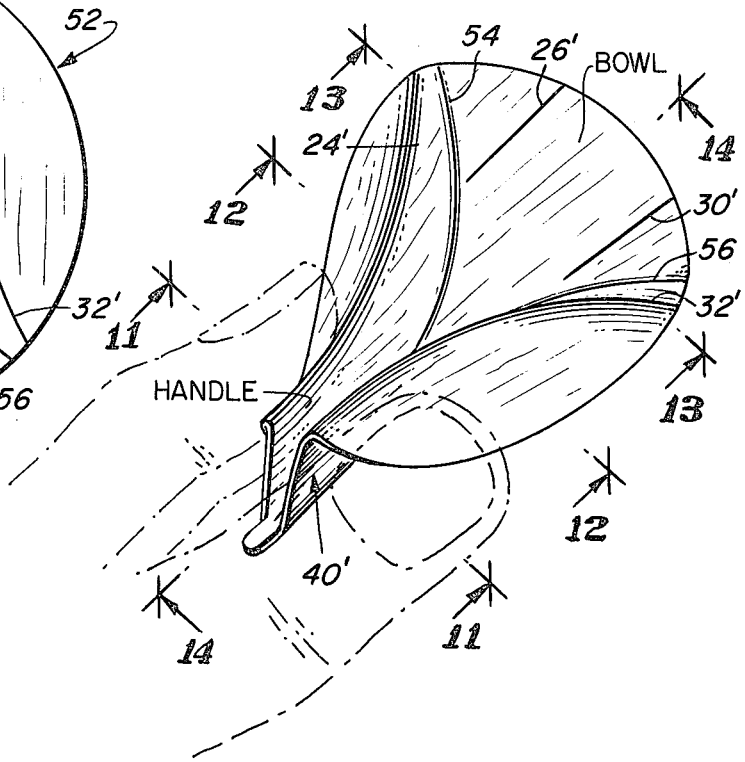
FIG. 11
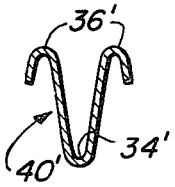
FIG. 12
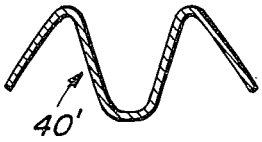
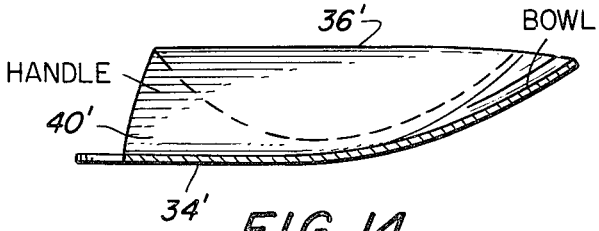
FIG. 14
FIG. 13
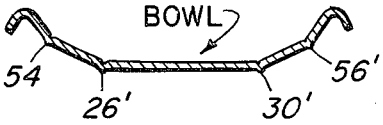

PAPERBOARD CONTAINER LID CONVERTIBLE INTO A SPOON

BACKGROUND OF THE INVENTION

1. Field of the Invention

Container lid convertible into an eating utensil.

2. Description of the Prior Art

Heretofore, it has been customary to furnish inexpensive, flat, thin wooden spoons, usually individually wrapped in light paper, to assist in eating the contents of a container. Typical contents have been frozen ice cream, soft ice cream, frozen desserts, ices, etc. The containers typically were open-topped and were closed by flat paperboard disc lids having tabs to facilitate disengagement with the containers. Inexpensive as the spoons were, they nevertheless represented, en masse, a considerable cost. By way of example, such spoons currently cost about $2.30 per thousand. Aside from costs, the spoons were furnished separately from the containers and often were available in too great or too small a supply. It has been the trade custom to supply an extra quantity of spoons to purchasers of containers in order to ensure that each container would have a spoon. Futhermore, the spoons often split and broke. When the spoons were unwrapped, they were unsanitary. On occasion, some spoons, all of which were supposedly well sanded and smooth, were rough, with consequent inability to use the same without discomfort.

SUMMARY OF THE INVENTION

1. Purposes of the Invention

It is an object of the invention to provide a novel spoon which avoids the foregoing defects.

It is another object of the invention to provide a spoon of the character described which is convertible from a paperboard flat lid that also is used to close the open top of a container in which the comestible to be eaten with the spoon is packed.

It is another object of the invention to provide a spoon of the character described which is easy to use, constitutes but a single part and is convertible rapidly by the least skilled of persons from an aforesaid lid.

It is another object of the invention to provide a spoon of the character described which is uniquely individually associated with a single container, so that the spoon is immediately available for use to eat the contents of the container.

It is another object of the invention to provide a spoon of the character described which totally eliminates the cost of a separate spoon such as currently is supplied.

It is another object of the invention to provide a spoon of the character described which is particularly strong, i.e., capable of ladling out quite hard comestibles, even as hard as frozen ice cream, ices and desserts.

It is another object of the invention to provide a spoon of the character described which is readily constructable to be supplied and used in a sanitary condition.

It is another object of the invention to provide a spoon of the character described which is extremely inexpensive.

Other objects of the invention in part will be obvious and in part will be pointed out hereinafter.

2. Brief Description of the Invention

A spoon which is transformed from an essentially standard die-cut tab lid for an open-mouthed container. The lid, basically, is circular and flat. It is made from paper having a grain. The lid is formed with weakened zones, as by the provision of crease-score lines. The weakened zones are individually narrow and are so spaced and oriented that by simple manual manipulation of the lid, constituting, in essence, partial folding and bending along such zones, the lid is converted into a rather strong spoon-like eating implement having a spade-like blade and an integral sturdy handle. Such folding and bending action best is compared to the so-called "origami" technique. The external surface of the lid (when used as a lid) is protected against dirt and contaminants by a thin, flexible, strippable covering such as waxed paper, tissue paper, glassine or plastic film.

The invention consists in the features of construction, combination of elements and series of steps which will be exemplified in the container lid hereinafter described and of which the scope of application will be indicated in the appended claims.

BRIEF DESCRIPTION OF THE DRAWINGS

In the accompanying drawings in which are shown various possible embodiments of the invention:

FIG. 1 is an axial fragmentary sectional view of an open-mouthed container which is closed by a lid/spoon embodying the present invention;

FIG. 2 is a top plan view of the lid/spoon in flat (unfolded and unbent) condition as it originally is made and used to close the container;

FIG. 3 is a perspective view of the lid/spoon as it appears when folded and bent to serve as a spoon;

FIGS. 4, 5, 6 and 7 are sectional views taken substantially along the lines 4—4, 5—5, 6—6 and 7—7, respectively, of FIG. 3;

FIG. 8 is an enlarged fragmentary view taken substantially along the line 8—8 of FIG. 2;

FIG. 9 is a view similar to FIG. 2 of a lid-spoon embodying a modified form of the invention;

FIG. 10 is a perspective view similar to FIG. 3 of the lid/spoon of FIG. 9; and FIGS. 11, 12, 13 and 14 are sectional veiws taken respectively along the lines 11—11, 12—12, 13—13 and 14—14 of FIG. 10.

PREFERRED EMBODIMENT OF THE INVENTION

Referring now in detail to the drawings, the reference numeral 10 denotes a conventional container such as is used in huge quantities to package sundry foodstuffs such as, by way of example, frozen ice cream, soft ice cream, custards, frozen desserts, ices, sherbets, salads, spoonable cheeses like cottage cheese, yogurt and sour cream. Typically, such containers are made from paperboard or plastic. They have a form-reinforced rim 12 below which is indented annular groove 14 known as a "cap seat." In a conventional container a flat paperboard lid is snapped into the cap seat. The lid includes a lifting tab to assist in removal. Heretofore such containers were at the line of sale supplied to the purchaser with a wrapped wooden spoon, a separate one for each container. The lids were thrown away after the container was opened.

Pursuant to the present invention, the container is provided with a lid 16 which on casual inspection is no different from the lid heretofore used. There is, however, a quite substantial, although almost unnoticeable, difference in structure that enables the lid, after removal from the container and suitable manipulation, to constitute an excellent spoon with the aid of which to eat the contents of the container.

The lid is fabricated, as by die cutting, from paperboard. It should be noted that paperboard is a product which, as is well known, has a grain. The grain of paperboard imparts a certain differential stiffness to the board, the stiffness characteristically being less when the board is bent about a zone parallel to the grain and greater when the board is bent about a zone perpendicular to the grain. The present invention utilizes this characteristic of differential thickness in a novel manner to impart a useful degree of rigidity to the spoon formed from the lid, which rigidity is such that the spoon is able to scoop up rather hard as well as soft textured comestibles without mutilation. To take advantage of the differential thickness the lid includes weakened zones having orientations which are specially related in a mutual angular sense to the direction (orientation) of the grain, although it is clearly to be understood that this relationship is simply a feature of the preferred embodiment of the invention now being described and that it is within the ambit of the invention to simply provide the weakened zones hereinafter detailed without the most desirable relationship to the grain, it being understood that where such relationship is not utilized the spoon formed from the lid is not as strong; nevertheless, even a weaker spoon is useful for many applications, e.g., where the material to be dispensed is soft textured.

A good thickness of paperboard for use in the invention is that customarily employed for snap-in flat-tab disc lids for containers. By way of example, a suitable thickness is about 0.025, inch it being understood that such dimension is only illustrative and is not to be considered as limitative. A suitable paperboard material mentioned by way of completeness is "solid bleached sulfate" which is the trade designation for paperboard.

The weakened zones which are the primary feature of the present invention, when considered as part of an otherwise standard lid of the character described, desirably are in the form of crease/score lines which are thinner sections of the lid. The said lines most readily are provided by the use of steel rule creasing dies that are pressed (in the proper locations) into a surface of the lid the opposite surface of which is supported on a flat block. The dies are indented sufficiently into the lid to leave a visible, although not necessarily noticeable, score line. The pressure is sufficient to leave a slight ridge on the opposite surface of the lid, and even better results (easier folding) are obtained if the surface of the block is lightly grooved to receive the ridge. Solely by way of example, a ridge in the order of 0.015 to 0.025 inch provides acceptable results.

Turning now to the configuration of the weakened zones and, for the moment, disregarding the grain direction, the zones include at least three handle zones 18, 20, 22 that are substantially parallel to one another and are spaced apart from one another. The zones 18, 20, 22 have one end adjacent, i.e., at or near the periphery of the lid 16. The peripheral ends of the outermost zones 18, 22 should not be spaced apart more than about 90°. Preferably, the angular spacing of these peripheral ends is in the order of 45°. Even lesser angular spacing produces usable results. The intermediate zone 20, if only one is used, desirably is midway between the outer zones. If more than one intermediate zone is employed, best results are secured where the spacing between them and the outermost zones is uniform, although, again, acceptable results do not require such uniformity. The general directions of the outermost zones 18, 22 are such that these zones are approximately symmetrical with respect to and on opposite sides of a diameter of the lid. In this preferred form, which takes into account grain direction, the general directions of the outermost zones additionally are parallel to grain direction. It should be noted that the outermost zones do not have to be exactly or even closely parallel to one another. They may converge somewhat, e.g., up to an included angle of about 15°, or diverge up to about the same included angle. The reason for this will become apparent shortly. The intermediate zone, if only one, will bisect the space between the outermost zones, regardless of whether the latter are parallel, converging or diverging. If there is more than one intermediate zone, for the sake of appearance of the lid and the handle of the spoon to be formed therefrom, an intermediate zone other than the central one will be symmetrical about the bisecting diameter with respect to an opposed intermediate zone.

The lengths of the outermost intermediate zones can vary quite widely as a fraction of the diameter of the lid. In the example shown, these zones extend from the periphery to the transverse diameter. The purpose of the zones 18, 20, 22 is, as soon will be detailed, to aid in the formation of a handle so that the length of the zones will be governed by the desired length of the handle, hence, the non-criticality of such lengths.

Said zones 18, 20, 22, since they are employed to assist in forming the handle, conveniently are referred to as the "handle" zones.

The weakened zones further include "bowl" zones 24, 26, 28, 30 and 32. The bowl zones extend, in general, from the transverse area at which the handle zones terminate and run to adjacent (at or near) the opposite arc of the periphery of the lid.

More bowl zones conveniently are employed than handle zones, although this is not essential. An excellent arrangement of bowl zones is seen in FIG. 2. The outermost bowl zones 24, 32 extend from the inner ends of the outermost handle zones 18, 22. These outermost bowl zones angle outwardly at about 15° to the associated handle zones while the intermediate bowl zones 26, 28, 30 have a mutually fan-like relationship. The central bowl zone is spaced from the central handle zone but in line therewith to increase the rigidity of the junction between the to-be-formed handle and the to-be-formed bowl.

It is within the scope of the invention to include bowl zones which have greater or lesser flaring (diverging angles), even bowl zones that are parallel to the bisecting diameter and bowl zones that converge. However, these are not desirable because they do not obtain a broad spade-like bowl which is highly satisfactory as a scoop.

To transform the lid 16 with its sundry weakened zones into a spoon, certain manual manipulative steps are practiced, the reading of the explanation of which takes much longer than the time required to make a spoon from the lid. Essentially, all that is done is to press down on the center of the lid between the outermost handle zones and the outermost bowl zones and preferably, although not necessarily, concurrently press down on the lid outwardly of the handle zones. This can be done quite simply by forcing one's index finger down between the lines 20 and 28 while at the same time forcing one's thumb and middle finger against the periphery of the lid outwardly of the outermost handle zones — thus the requisite configurative folding can be accomplished with one hand.

The folded spoon can be appreciated from inspection of FIG. 3 and the several sections of the same. At the folded handle there is a central trough 34 which rises at opposite sides to form elongated peaks 36 that descend remotely from the trough as lips 38. Considered as a whole, the thus-formed handle 40 is of M-shape in cross-section (see FIG. 4).

It will be appreciated that the M-shaped handle constituting parallel pleats extending in a direction parallel to a diameter of the lid is considerably stronger in this configuration than the flat portion of the lid from which it was formed due to the reinforcing effect secured by the pair of substantially parallel ridges of which the handle now is constituted. Similarly, the bowl portion of the lid is reinforced by continuations of the aforesaid ridges. Furthermore, the bowl and handle are reinforced against bending in a direction perpendicular to the lengths of the handle and bowl by virtue of the paper grain because, as it will be recalled, the sundry score lines and the various peaks and troughs of the handle and bowl extend in a direction generally parallel to the paper grain, so that there is a strong resistance to bending perpendicular to the grain. It has been found that a handle thus constructed from a lid operates quite well for dispensing the contents of a single container, which is all that is required inasmuch as the spoon from which the handle has been formed is intended to be discarded after such a single use. The term "single use" is not intended to denote transferral of only one portion of a comestible from a container 10 to a user's mouth, but, rather, a series of such transferrals until the contents of the container have been substantially completely consumed.

Attention is called to the portions of the handle and of the bowl which lie outwardly of the score/crease lines 18/24 and 22/32. These portions constitute the downwardly depending lips of the M-shaped cross-section. They function, in addition to the reinforcing provided by virtue of the peaks, as rests for a user's fingers when he is manipulating the converted lid/spoon.

Attention also is drawn to the outwardly flaring configuration of the bowl, that is to say, the outward flare from the terminating of the handle portion. This provides a rather wide shovel-like instrument which is of suitable size to fit into the container from which the lid has been lifted and also is large enough to scoop up enough comestible to make the lid/spoon desirable to use, while at the same time not being so large that it cannot easily be introduced into a person's mouth. The peaks 36 which extend from the handle down to the bowl and essentially define the lateral edges of the bowl also reinforce the bowl, so that when the scooping is performed and when the contents are introduced into a person's mouth the bowl tends to retain its original shape at least long enough for the contents of the container to be consumed.

Finally, attention is directed to FIG. 3 where it will be seen that during the use of the lid/spoon as an eating implement it easily can be grasped between the thumb and index finger of a person who will squeeze together the M-shaped handle portion, thus further increasing the rigidity of the handle portion.

Still further, by having the peaks of the handle and of the spoon constitute continuations of one another, i.e., by running the crease/score line 18 into the crease/-score line 24, and similarly for the lines 22, 32, any tendency for the thus-formed spoon to flex transversely at the junction between the handle and bowl is minimized.

The lid includes, as does any conventional lid, a pull tab 42, the position of which is of no particular importance, but, in order not to interfere with the converted spoon, desirably is located in the handle part of the lid, for example, protruding from the perimeter of the lid midway between the perimetral ends of the crease/-score lines 18, 22.

It will be appreciated that when the container is shipped in commerce, transferred to a display location, and handled by purchasers and at the checkout counter, the exterior surface of the lid inevitably will be contaminated and would be considered unsanitary by health authorities. This objection can be avoided in two ways. One way is to place the crease/score lines so that the face of the bowl portion constitutes the undersurface of the lid when the lid closes the container. This is not particularly satisfactory for various reasons, one being that the external surfaces of the lips 38 which would be contacted by a user's fingers would be covered with a film of the product and might be slippery, making the lid/spoon somewhat difficult to hold. The second reason is that, even though the food as it is transferred from the container to a person's mouth, would be principally located, and hopefully entirely located, on the upper surface of the spoon portion, nevertheless, the undersurface of the spoon portion almost inevitably will come into contact with the food in the container and, if the undersurface were contaminated, unsanitary conditions might be considered to prevail.

Therefore, pursuant to the present invention, a second solution to the problem is employed, to wit, sanitizing both surfaces of the lid/spoon when the same is employed solely to close the lid of a filled container. The undersurface of the lid is inherently maintained sanitary by being in a sanitary condition when used to close the lid at the food packer's. It is the upper surface which creates the problem. Pursuant to a feature of the present invention, this upper surface is maintained sanitary by virtue of the construction illustrated in FIG. 8. The lid 16 here is indicated as being provided with an undersurface 44 which is the surface that faces inwardly of the container 10 and, therefore, is sanitary when the lid is emplaced. The upper surface of the lid 16 is denoted by the reference numeral 46. This upper surface is protected against contamination by providing thereon a strippable covering, i.e., layer 48. This layer can be made of any thin, flexible material such, for instance, as waxed paper, tissue paper, glassine or plastic. It may be a printable material. It may be opaque or transparent. Its sole function, insofar as the present invention is concerned, is to maintain intact the sanitary condition of the upper surface 46, that is to say, to prevent this upper surface from being contaminated any time prior to use of the lid as a spoon. Said layer 48 is lightly bonded to the upper surface 46. For example, the undersurface of the layer 48 may be provided with a coating 50 of a pressure-sensitive adhesive which forms a good bond with the undersurface of the layer 48 and a weak bond with the upper surface of the lid 16. A typical such adhesive is a rubber-base adhesive, the weak bond between this adhesive and the lid 16 being secured by application of a very thin coating (not shown) of release material such as Quilon or silicone.

Prior to converting the lid into a spoon and after the lid has been removed from the container, the layer 48 is stripped off leaving a virgin upper surface 46 ready to serve as a clean, fresh spoon after the same has been converted by origami technique.

When the folding takes place which converts the lid into a spoon, and with the crease/score lines as indicated in FIGS. 1 – 8, the bowl portion of the spoon has its base slightly angularly lifted with respect to the base of the handle portion of the spoon, as best can be seen in FIG. 7.

Although people are accustomed to eating foodstuffs of the character under consideration with a spoon having a bowl that is almost coplanar with the handle, having become so accustomed by the utilization of flat wooden spoons, some people might consider it more desirable to raise the angle of the bowl portion somewhat so that the angular relationship between the handle and the bowl is more like that of a conventional metal or plastic spoon. This readily can be accomplished and at the same time the bowl portion is somewhat stiffened and better defined whereby to make the spoon easier to use as an eating implement by slightly varying the configuration and arrangement of the crease/score lines in the manner indicated in FIG. 9; the same variation imparts a more esthetic overall appearance to the converted spoon.

Such variation is emobodied in the lid/spoon 52 illustrated in FIGS. 9 – 13. Inasmuch as the variation is a rather slight one, although its effect is significant, the same reference numerals will be used to denote the same parts of the lid/spoon 52 of FIG. 9 as those used to denote the parts of the lid/spoon 16 of FIGS. 1 – 8, with the difference, however, that a prime is applied to the reference numerals of the lid/spoon 52.

Thus the lid/spoon 52 includes handle crease/score lines 18′, 20′ and 22′. Unlike the lines 18, 22 of the lid 16, the lines 18′, 22′ are parallel, that is to say, they do not diverge even slightly angularly outwardly. The bowl portion of the lid/spoon 52 includes outer crease/score lines 24′, 32′ as well as crease/score lines 26′, 30′. The lines 24′, 32′, unlike the lines 24, 32, are curved rather than straight. The curvature is such that the lines 24′, 32′ are outwardly concave. The lines 26′, 30′ do not angularly converge to the same extent as the lines 26, 30 and their inner ends extend less far inwardly than do the inner ends of the lines 26, 30. In other words, the lines 26′, 30′ are shorter (compared to the diameter of the lid) than the lines 26, 30. Moreover, the lid 52 has no crease/score/lines corresponding to the crease/score line 28. Furthermore, the lid 52 has two additional crease/score lines 54, 56. Each of these lines has one end at the inner end of the crease/score line 20′, the inner ends of the lines 54, 56 thereby being coincident. The lines 54, 56 sweep arcuately outwardly with respect to one another to terminate near the spoon portion terminations of the lines 24′, 32′, and between the terminations of the lines 24′, 32′ and the lines 26′, 30′, although substantially displaced from the lines 26′, 30′. The inner ends of the lines 26′, 30′ are spaced from the lines 54, 56.

The lid/spoon 52 is folded by manual manipulation in the same manner as described in detail with respect to the lid 16. However, the finished shape of the lid/spoon is somewhat different from the finished shape of the lid/spoon fashioned from the lid 16. The handle essentially is similar, as will be seen from comparison between FIGS. 4 and 11, where the peaks are denoted by the reference numerals 36′, the trough by the reference numeral 34′, the lips by the reference numeral 38′ and the handle by the reference numeral 40′. But the bowl portion, although generally similar in shape to the bowl portion of the lid/spoon 16, has a neater appearance. Thus, the base of the bowl portion, as can be seen in FIGS. 10 and 13, is flatter than the base of the bowl portion of the FIGS. 1 – 8 form of the invention. The sides of the base of the bowl portion are defined by the lines 54, 56 so that there is a definite corner at these sides which lends a feeling of good definition to the bowl, making it more readily acceptable as an eating implement than possibly the bowl of the converted spoon formed from the lid 16. Also, the fact that the lines 54, 56 sweep into convergence strengthens the throat of the lid/spoon where the bowl portion merges into the handle portion. Also, the outwardly curving configuration of the lines 54, 56 strengthen the sides of the base of the bowl. The combined curvature of the lines 24′, 32′, 54, 56 substantially reinforces the sides of the bowl portion providing a strength above that created by the simple angulation that is achieved when the lid 16 is folded to form dihedral angles at the lines 24, 32 in the FIGS. 1 – 8 form of the invention.

It thus will be seen that there are provided lid/spoons which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. For an open-top food container, a flat lid formed to cooperate with the container as a detachable closure therefor, said lid comprising: a flat panel the periphery of which is shaped to cooperate with the container so as to form a detachable cover therefor, said flat panel having formed therein a plurality of weakened zones so arranged with respect to one another and the panel that the panel is convertible by folding about said zones into a spoon having a handle portion and a bowl portion joined at a throat, the so-formed handle constituting a pleated arrangement extending diametrically of the panel from a perimeter of the panel to the throat of the spoon, and the so-formed bowl constituting a scoop-shaped portion extending from the handle at the throat to the opposite perimeter of the panel, the weakened zones in the handle portion including three zones substantially parallel to one another with the intermediate zone lying substantially on a diameter of the panel, the remaining two zones being outer zones, and the weakened zones of the bowl portion including two outer zones extending away from the inner ends of the outer zones of the handle portion and flaring away from one another, and at least one intermediate zone, the portions of the panel outwardly of the outer zones in the so-formed spoon constituting downwardly extending lips.

2. A lid as set forth in claim 1 wherein the outer zones of the bowl portion are convex toward one another.

3. A lid as set forth in claim 2 wherein the bowl portion includes two additional weakened zones each starting at the inner end of the intermediate zone of the handle portion and curving outwardly away from one another to define the side edges of the base of the so-formed bowl.

* * * * *